US006361421B1

(12) United States Patent
Kündig

(10) Patent No.: US 6,361,421 B1
(45) Date of Patent: Mar. 26, 2002

(54) BELT GRINDER WITH PIVOTABLE GRINDING UNIT AND OPPOSITE SUPPORTING TABLES AT DIFFERENT WORKING HEIGHTS

(76) Inventor: Stephan Kündig, Haldenstr. 20, Rapperswil SG (CH), CH-8640

( * ) Notice: Subject to any disclaimer, the term of this patent is extended or adjusted under 35 U.S.C. 154(b) by 0 days.

(21) Appl. No.: 08/952,947

(22) Filed: Nov. 17, 1997

(30) Foreign Application Priority Data

May 22, 1995 (CH) ..... 1504/95

(51) Int. Cl.[7] ..... B24B 21/00
(52) U.S. Cl. ..... 451/310; 451/340; 451/411
(58) Field of Search ..... 451/296, 310, 451/340, 411; 29/434, 469

(56) References Cited

U.S. PATENT DOCUMENTS

| | | | | |
|---|---|---|---|---|
| 165,762 A | * | 7/1875 | Sawyer | 451/310 |
| 1,798,421 A | * | 3/1931 | Hitchcock | 451/310 |
| 3,133,384 A | | 5/1964 | Liard | |
| 3,136,097 A | * | 6/1964 | Liard | 451/310 X |
| 4,346,536 A | | 8/1982 | Bryden | |
| 4,926,602 A | | 5/1990 | Crouch | |

FOREIGN PATENT DOCUMENTS

EP 0 827 441 B1 3/1998

OTHER PUBLICATIONS

Kundig Uniq, Edge Sanding, Kundig Uniq–Edge Sanding, Publication Date was Prior to this Application was Filed, 4, N/A, N/A, N/A, Kundig.

* cited by examiner

*Primary Examiner*—Timothy V. Eley
(74) *Attorney, Agent, or Firm*—Adams, Schwartz & Evans, P.A.

(57) ABSTRACT

The invention relates to a belt grinder of which the supporting tables (13, 14) are arranged in relation to the grinding unit (11) and hence the grinding belt (12) in such a way that tables need not be adjusted at the same time as the grinding unit is pivoted, while nevertheless the gap (z) between the grinding unit and the edges of the tables remains minimal. Such an arrangement is obtained if the value one minus the cosine of half the maximum pivoting angle (y) multiplied by the direct distance (d) between the tables edges is divided by two and the cosine of half the maximum pivoting angle (y) and gives a result acceptable for practical use and compliance with the standards and safety specifications for the gap (z) between the table edges and the grinding unit.

8 Claims, 2 Drawing Sheets

Figure 1:
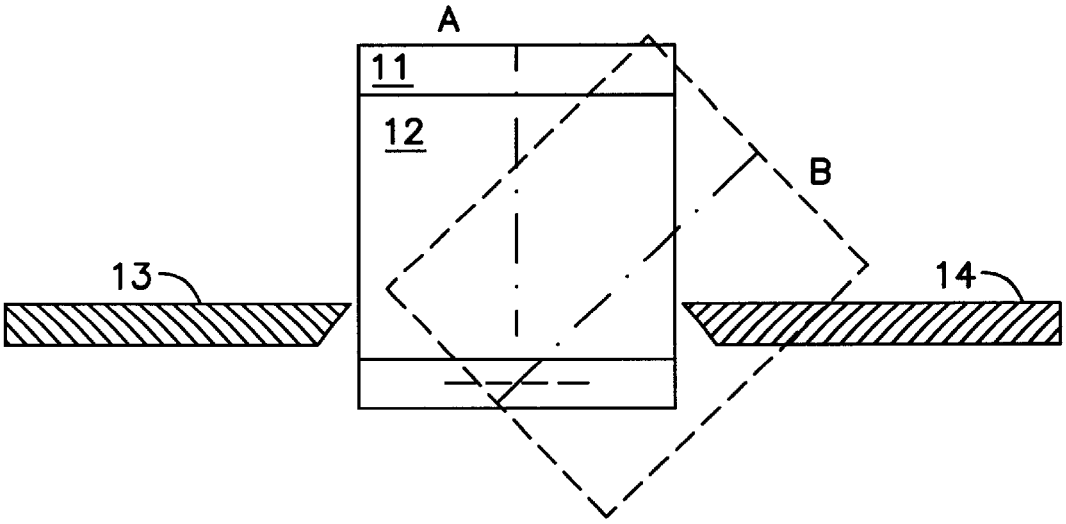
FIG. 1 PRIOR ART
Figure 2:
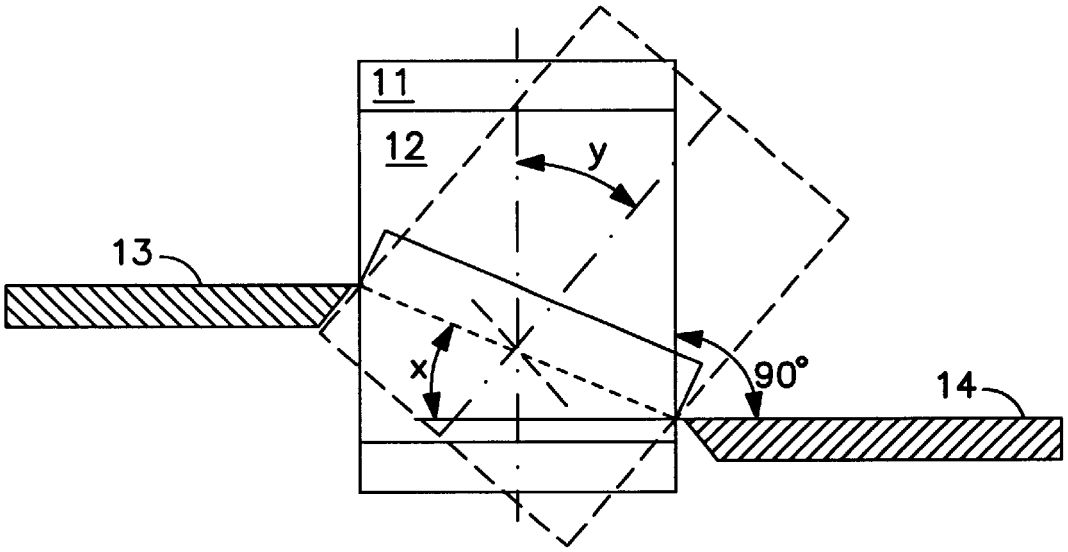
Figure 3:
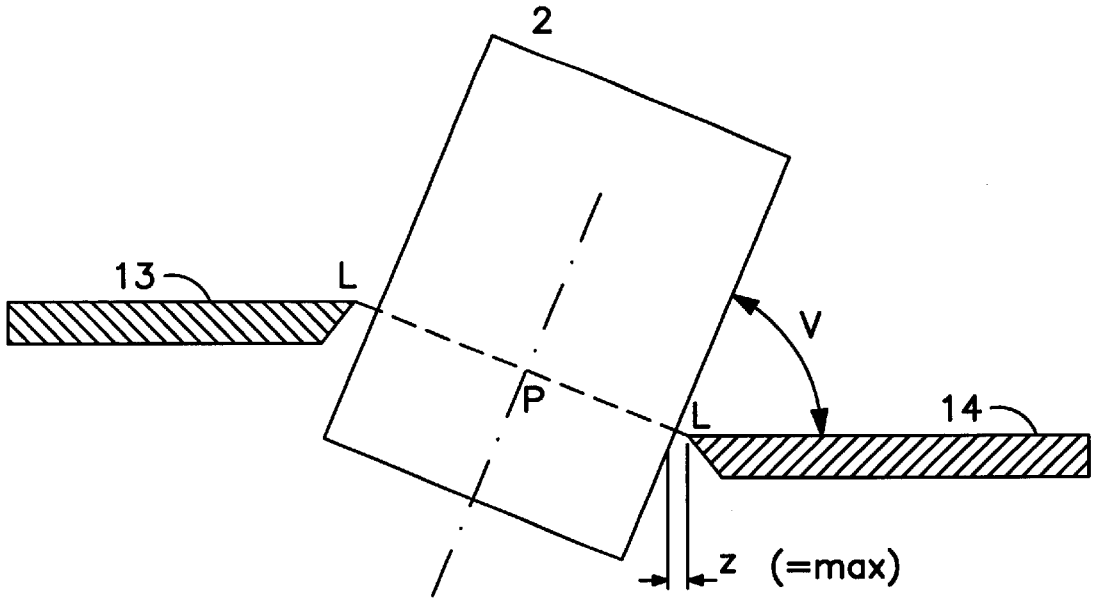
Figure 4:
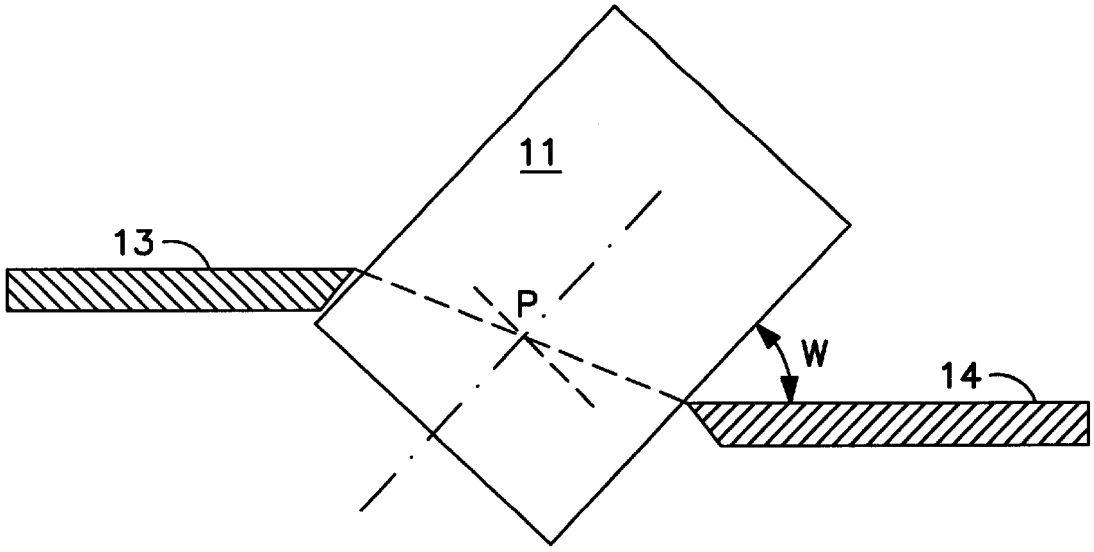

BELT GRINDER WITH PIVOTABLE GRINDING UNIT AND OPPOSITE SUPPORTING TABLES AT DIFFERENT WORKING HEIGHTS

SUMMARY

The invention refers to a band sanding device whose support tables (13, 14) are positioned relative to the sanding unit (11), and thereby the sanding band (12), in such a way that when the sanding unit is rotated no simultaneous readjustment of the table is required) and the gap (z) between the table edges and the sanding unit remains minimum. This arrangement is achieved if the straight line distance (d) between the table edges is multiplied by one minus the cosine of half the maximum rotation angle (y), divided by two times the cosine of half the maximum rotation angle (y), and the resulting gap (z) between the table edges and sanding unit is acceptable for practical applications and in conformance with standards and safety regulations.

This invention refers to a band sanding device as described in patent application claims 1, 2, 3, 4 and 5.

To illustrate this device there are

Drawing 1, operation principle projection of the standard design of a band sanding machine with rotatable sanding unit 11 and sanding band 12, in positions A and B, and the two opposing workpiece support tables 13 and 14 on the same level.

Drawing 2, operation principle projection of the new arrangement of the support tables 13 and 14 at differing levels, with a separation d between the two table edges, angle y for the entire rotation range and angle x between the two table heights, this being the starting position with vertical sanding unit 11, without gap between table edges and sanding unit.

Drawing 3, operation principle projection, similar to drawing 2, but with a rotation of the sanding unit with centre of rotation p and angle v, with gap z between the table edges and the sanding unit at its maximum.

Drawing 4, operation principle projection, similar to 2, but with a maximum rotation of the sanding unit with angle w, without gap between the table edges and the sanding unit.

Edges and small surfaces are sanded mainly on so-called edge sanding machines, with a vertically positioned, horizontally rotating and usually height-adjustable band 12. Such machines are often fitted with two working sides lying opposite each other, equipped differently, each with a support table 13, 14. For sanding surfaces not perpendicular to the support table, there are two design variations possible: in one the support table is inclined while the sanding unit remains vertical, while in the other the sanding unit is inclined while the support remains horizontal. Such a device is described, for example, in Document U.S. Pat. No. 4,346,536. This invention also refers to such an arrangement. It has been necessary till now however, in this arrangement to adjust the horizontal position of the work table each time to the changes of inclination of the sanding unit. This becomes apparent by comparing positions A and B in Drawing 1, and also involves the arrangement as shown in Document U.S. Pat. No. 4,346,536.

If, to the contrary, as described patent Claim 1 tables 13, 14 are positioned at different levels, this makes possible a rotation of the sanding lacross a certain range without simultaneous adjustment of the horizontal position of the support table.

For reasons of convenience of use and safety regulations, it is also necessary in practice to keep the gap z created by the rotation of the sanding unit between the table edge and sanding band as small as possible. This in turn requires a specific positioning of work tables 13, 14 relative to each other and the centre of rotation P of sanding unit 11, which can be definitively derived from the following.

Take angle y as the desired, maximum rotation range.

The rotation through angle x to the edge of the upper table occurs about the lower table. x is therefore half of y. The direct distance d between the table edges is calculated from the following formula:

$$d = \frac{2z\cos x}{1-\cos x},$$

where x=y/2 where gap z between the sanding unit and tables for application, safety and other reasons is usually defined as the maximum. By rearranging the above formula now dependent on distance d, gap z can now be calculated as follows:

$$z = \frac{d(1-\cos x)}{2\cos x},$$

where x=y/2

When the values are calculated, the point of rotation of the sanding unit will come to lie on the middle point P of straight fine LL between the two table edges.

Angle x, the difference in levels of the tables, distance d between the table edges, and the tolerable gap z between the sanding unit and the table edges, the positions of the table and the point of rotation of the assembly can be calculated very clearly.

Parameters determined from experience, such as the German GS testing prescribed maximum gap z of 8 mm, allow a problem free dimensioning of the machine to suit specific applications. The maximum gap is reached with a rotation of the sanding unit about an angle v. The value of v is calculated from the difference between angle x and a right angle of 90 degrees.

What is claimed is:

1. A belt sanding device comprising a vertically positioned rotatable sanding unit, and two horizontal table members positioned opposite from each other at opposing sides of said sanding unit, said table members having a position on different horizontal planes such that said sanding unit may rotate without adjusting the position of said table members, said sanding unit and said table members being carried on a base member.

2. The device of claim 1, further comprising a rotatable sanding unit mounted on said sanding belt.

3. The device of claim 1, wherein said table members have inner edges facing said sanding unit, and the position of each said table member on a horizontal plane is determined by a relation of the distance between said inner edges of said table members to a center of rotation of said sanding unit.

4. The device of claims 1, 2 or 3, further comprising a space having a horizontal length defined by said sanding unit and said inner edge of one said table member, wherein the distance between said inner edges of said table members equals twice the horizontal length of said space multiplied by the cosine of one-half of a desired maximum angle of rotation of said sanding unit divided by the difference of one minus the cosine of one-half of said desired maximum angle of rotation.

5. The device of claim 4 wherein said space defined by said sanding unit and said inner edge of one said table member has a maximum allowable horizontal length.

6. The device of claim 4 wherein said desired maximum angle of rotation of said sanding unit equals an angle of inclination between said edges of said table members multiplied by two.

7. A method for forming a belt sander comprising the steps of:

a) connecting a sanding unit to a tubular member and mounting said tubular member to a base;

b) connecting two horizontal table members to respective tubular members and mounting said tubular members to said base at opposing sides of said sanding unit; and c) positioning said table members on said tubular members at different horizontal planes such that said sanding unit may rotate without adjusting the position of said table members, said table members having inner edges facing said sanding unit.

8. The method of claim 7, wherein the step of positioning said table members on said tubular members further comprises determining the proper horizontal planar position for each said table member based on a desired maximum angle of rotation of said sanding unit, said proper horizontal planar position being defined by a certain distance between said inner edges of said table members with respect to a center of rotation of said sanding unit, said certain distance obtained by multiplying a horizontal length of a space defined by said sanding unit and said inner edge of one said table member by two and the cosine of one-half of said desired maximum angle of rotation of said sanding unit and dividing the resulting product by the difference of one minus the cosine of one-half of said desired maximum angle of rotation.

* * * * *